US005860587A

United States Patent [19]

Young

[11] Patent Number: 5,860,587

[45] Date of Patent: Jan. 19, 1999

[54] PACKAGING FOR A FOOD ITEM

[75] Inventor: Andrew Robert Young, Perth, Australia

[73] Assignee: Orphean Nominees Pty Ltd., West Perth, Australia

[21] Appl. No.: 793,812

[22] PCT Filed: Aug. 25, 1995

[86] PCT No.: PCT/AU95/00544

§ 371 Date: Feb. 18, 1997

§ 102(e) Date: Feb. 18, 1997

[87] PCT Pub. No.: WO96/06781

PCT Pub. Date: Mar. 7, 1996

[30] Foreign Application Priority Data

Aug. 26, 1994 [AU] Australia ..... PM7710

[51] Int. Cl.[6] ..... B65D 5/00

[52] U.S. Cl. ..... 229/107; 229/938; 229/117.24

[58] Field of Search ..... 206/817; 229/938, 229/107, 117.19, 117.23, 117.24, 117.25, 122; 426/115, 11; 221/79, 81

[56] References Cited

U.S. PATENT DOCUMENTS

| | | | |
|---|---|---|---|
| 1,844,066 | 2/1932 | Hughes | 206/815 X |
| 3,355,082 | 11/1967 | Wood | 206/815 X |
| 4,189,054 | 2/1980 | Liu et al. . | |
| 5,181,649 | 1/1993 | Frost . | |
| 5,507,579 | 4/1996 | Sorenson | 229/938 X |

FOREIGN PATENT DOCUMENTS

| | | |
|---|---|---|
| 23300/25 | 10/1925 | Australia . |
| 2133/36 | 1/1937 | Australia . |
| 2407/38 | 1/1940 | Australia . |
| 4921/39 | 6/1940 | Australia . |
| 23993/53 | 12/1954 | Australia . |
| 482573 | 12/1974 | Australia . |
| A 1-48279/7 | 5/1980 | Australia . |
| A-39049/89 | 9/1990 | Australia . |
| A-89900/91 | 6/1992 | Australia . |
| 979302 | 1/1965 | United Kingdom . |
| WO 85/05612 | 12/1985 | WIPO . |
| WO 92/0487 | 6/1992 | WIPO . |

*Primary Examiner*—Gary E. Elkins
*Assistant Examiner*—Tri M. Mai
*Attorney, Agent, or Firm*—Merchant, Gould, Smith, Edell, Welter & Schmidt

[57] ABSTRACT

Packaging for accommodating a food item comprising a lower panel (12) and an upper panel (14) which are supported to be in spaced apart relationship to provide a space which is intended to accommodate the food item, a wall element (13) provided between the upper (12) and lower panel (14) to substantially surround the space and having at least a portion (20) capable of being moved across the space from one side of the space to an opposite side of the space, said side wall (13) at the opposite side being open or capable of being opened to permit access to the food item from the opposite side with movement of said portion (20) of the side wall, said upper panel (14) being removable from above the space to provide access to the space.

11 Claims, 3 Drawing Sheets

PACKAGING FOR A FOOD ITEM

FIELD OF THE INVENTION

This invention relates to packaging which can be utilised as a food holder and in particular which can be used with such items such as hamburgers, steak sandwiches, sandwiches, hot dogs and the like.

BACKGROUND OF THE INVENTION

In the past, various forms of packaging have been proposed for use with food items of the form referred to above and examples of such packaging are disclosed in British patent specification 979302, U.S. Pat. No. 4,189,054 and Australian patent specifications AU-A-39049/89, AU-A-89900/91 and AU-A-89269/91.

A common difficulty with food items of the form described above relates to spillage that occurs while they are being consumed. It is a common occurrence that as one eats the item from one side, the contents and/or sauces or condiments within the food item spill from the other sides. This creates provides a significant disadvantage in the marketing of such products where the customers are concerned about the state of their clothing after they have consumed such a food item. It is highly desirable property of packaging which is utilised with food items of the type referred to above, that the packaging be capable of accommodating the spillage of any materials from the food item, such as sauce or condiments, and that the packaging limits the loss of contents from the food item during its consumption whereby on completion of the food item, the packaging can be disposed of together with any spillage that has occurred.

A further difficulty with food items of the form referred to above relates to the production of those items and after their production, the transferral to the packaging in which they are to be delivered to the customer. It is usual practice that the food item is assembled on a bench and on its completion is then transferred to the packaging either immediately or at the time of delivery to the customer. This method of assembly creates significant difficulties particularly where the contents between the two outer layers is bulky. It is common that during the assembly of the food item, considerable spillage can occur onto the bench surrounding the area in which it is being assembled and that on transferral of the completed food item into the packaging or to the point of delivery, further loss of contents can occur. This detracts from the need to maintain a clean environment in food preparation areas. In addition, there is the overriding requirement that during the assembly of the food items, there be minimal contact by the personnel involved to reduce the likelihood of contamination of the contents. It is highly desirable that the amount of contact with the contents being introduced into the food item and that the food item itself, be minimised.

SUMMARY OF THE INVENTION

It is an object of this invention to provide packaging for a food item which assists in overcoming some of the difficulties referred to above.

Throughout the specification, the term food item shall be taken to include a burger, steak sandwich, sandwich, hot dog or the like item.

Accordingly, the invention resides in a packaging for accommodating a food item comprising a lower panel and an upper panel which are supported to be spaced apart to provide a space which is intended to support the food item, a side wall element between the upper and lower panel to substantially surround the space and having at least a portion which is capable of being moved across the space from one side of the space to the opposite side of the space, said side wall at said other side being open or capable of being opened to permit the movement of the food item from the other side with movement of said portion of the side wall, said upper panel being removable to provide access to the space.

According to a preferred feature of the feature, said side wall at said opposite side comprises at least one further portion capable of being folded outwardly from said opposite side to open said side wall.

According to a further preferred feature, an outer portion of the upper and lower panel in the region of the opposite side is capable of being folded away from said side wall.

According to a further preferred feature, the side wall comprises a main portion fixed around the lower panel and wherein said movable portion comprises a separate inner wall member located within the main portion of the side wall to lie closely adjacent the main portion, a handle provided on the movable portion and extending outwardly beyond the main portion to be manipulable to effect said movement of said movable portion.

According to a preferred feature, said opposite side is closed by said side wall which is provided with a pair of interengagable end portions at least one of which can be disengaged from the other end portion and folded outwardly from the opposite side to open the side wall.

According to one embodiment, the upper panel is separate from the side wall and lower panel.

According to another embodiment, the upper panel is connected to the side wall through a fold line. In one form of the embodiment, the upper panel and upper edges of the side wall are interengagable to resist unintentional disengagement therebetween.

According to a preferred feature, the side wall is capable of being opened at said opposite side to form a pair of end portions and whereby the side wall is able to move across the space. In one form, the upper panel is supported from the lower panel by a fold line to be movable between a closed position across the space and an opened position clear of the space. The upper panel can comprise a pair of portions each connected to opposite sides of the lower panel and capable of being removed between the closed position and open position wherein when at the closed position, the adjacent edges of each portion can be interengaged.

BRIEF DESCRIPTION OF THE DRAWINGS

The invention will be more fully understood in the light of the following description of several specific embodiments. The description is made with reference to the accompanying drawings of which.

DESCRIPTION OF THE PREFERRED EMBODIMENT

Figure 1:
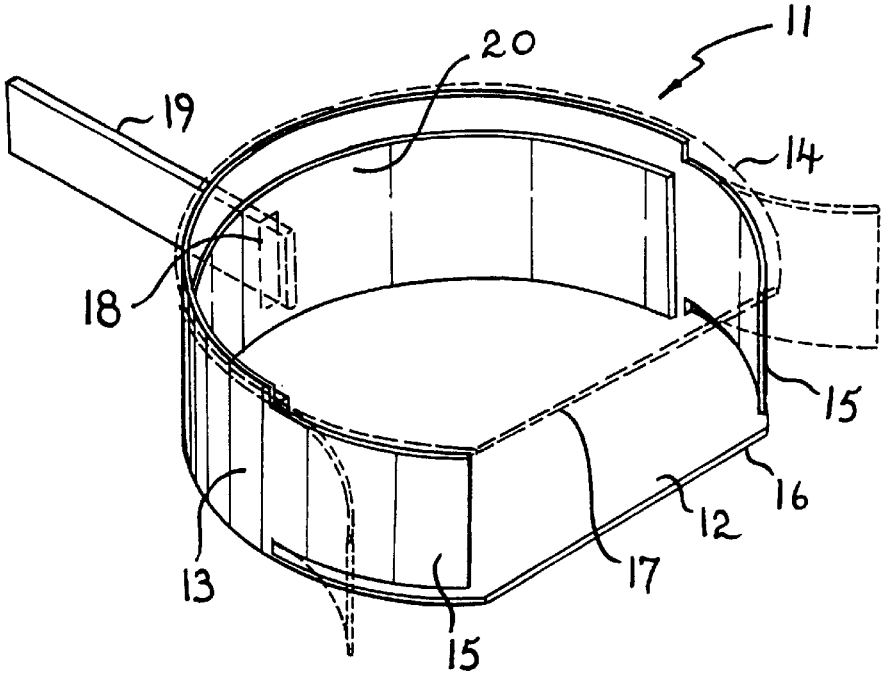
FIG. 1 is a isometric view of a first embodiment of the invention.
Figure 2:
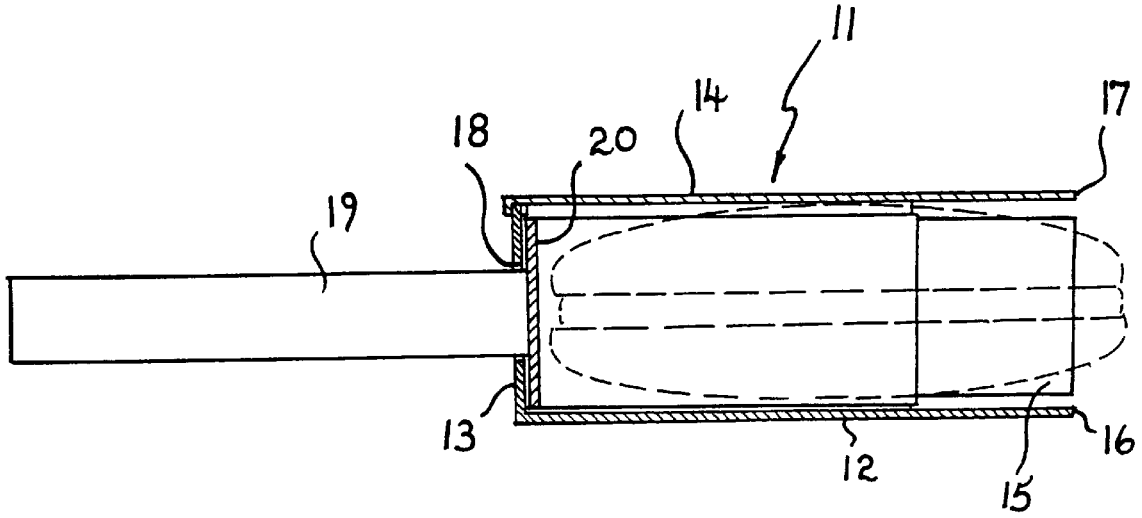
FIG. 2 is a cross-sectional view along line 2—2 of FIG. 1 with a burger therein.

The first embodiment shown at FIGS. 1 and 2 comprises a burger holder 11 having a lower panel 12 having a generally circular configuration but with one side cut away to provide a straight forward edge 16. The burger holder further comprises a side wall 13 which extends upwardly from the curved portion of the lower wall. An upper panel 14 which is of substantially corresponding configuration to the lower wall 12 and which has a straight forward edge 17 which is movably mounted to the upper edge of the side wall 13 whereby it can be placed in position over the side wall 13 to enclose the space defined between the upper and lower panel of the side wall or if desired can be removed from the upper edge of the side wall 13. If desired, suitable engagement means may be provided between the upper panel 14 and the upper edges of the side wall 13 to serve to retain the upper wall in position on the side wall 13 and resist undesired dislodgment with the side wall.

In use, the space defined between the upper panel 14 and the lower panel 12 is intended to accommodate a burger. As stated previously, the forward edges 16 and 17 of the lower and upper panels 12 and 14 respectively are cut away such that when the burger is located between the panels, a portion of the burger will lie exposed from the forward edges 16 and 17.

As shown, each outer end portion 15 of the side wall 13 and the region of the forward edges 16 and 17 of the upper and lower panels 12 and 14 are not fixed to the lower panel 12. This enables the end portions 15 to be folded outwardly away from the sides of the burger to provide access to the sides of the burger in that region. In another form, the outer end portions 15 may be fixed to the lower panel 12 by a severable junction such that it can be readily separated from the lower panel.

The side wall includes an inner member 20 which lies closely adjacent the inner face of the side wall 13 and is substantially semi-circular. In addition, the side wall 13 is provided with an opening 18 which is directly opposite the front edges 16 and 17 and the inner wall member 20 is provided with a handle 19 which extends through the opening 18. If desired, the junction of the handle 19 with the inner wall member 20 is provided by a fold to enable the handle 19 to be folded alongside the outer face of the side wall 13 when the inner wall element 20 is in close engagement with the inner face of the side wall 13. When the handle 19 is in a position extending radially outwardly from the side wall 19 (as shown), it can be used to cause the inner wall element 20 to move diametrically across the space in the direction of the forward edges 16 and 17.

In using the packaging of the first embodiment, the burger is assembled within the holder. This is effected by removal of the upper panel 14, location of the lower portion of the bun of the burger on the lower panel 12, depositing the contents of the burger onto the lower portion of the bun, locating the upper portion of the bun over the contents and then replacing the upper panel 14. During the assembly process, the burger is substantially contained by the lower panel 12 and the side wall 13 and on completion of the assembly process, the assembled package together with the burger can be delivered to the customer for consumption with minimal contact being effected between the personnel producing and handling the burger. Throughout the assembly procedure and the handling procedure, the side wall 13 limits the loss of contents from the side of the burger. As a result, the contents can be evenly distributed over the lower bun rather than in the middle which is the usual practice since the side wall retains the contents. Once assembled, the holder together with the burger can be stored and/or passed to the customer without the need for the burger to be handled in any way.

When it becomes appropriate to consume the burger, the front edge of the burger lies exposed at the front edges 16 and 17 of the lower and upper panels 12 and 14. In addition, the end portions 15 of the side wall can be bent outwardly from the side of the packaging to further expose the burger. As the burger is consumed, the handle 19 is used to push the inner wall element 20 and thus the burger across the space and out of the holder. The presence of the inner side wall 20 and the side wall 13 serves to retain the contents within the burger during its consumption and will collect any spillage of sauces, mayonnaise and the like which may spill from the burger.

Figure 3:
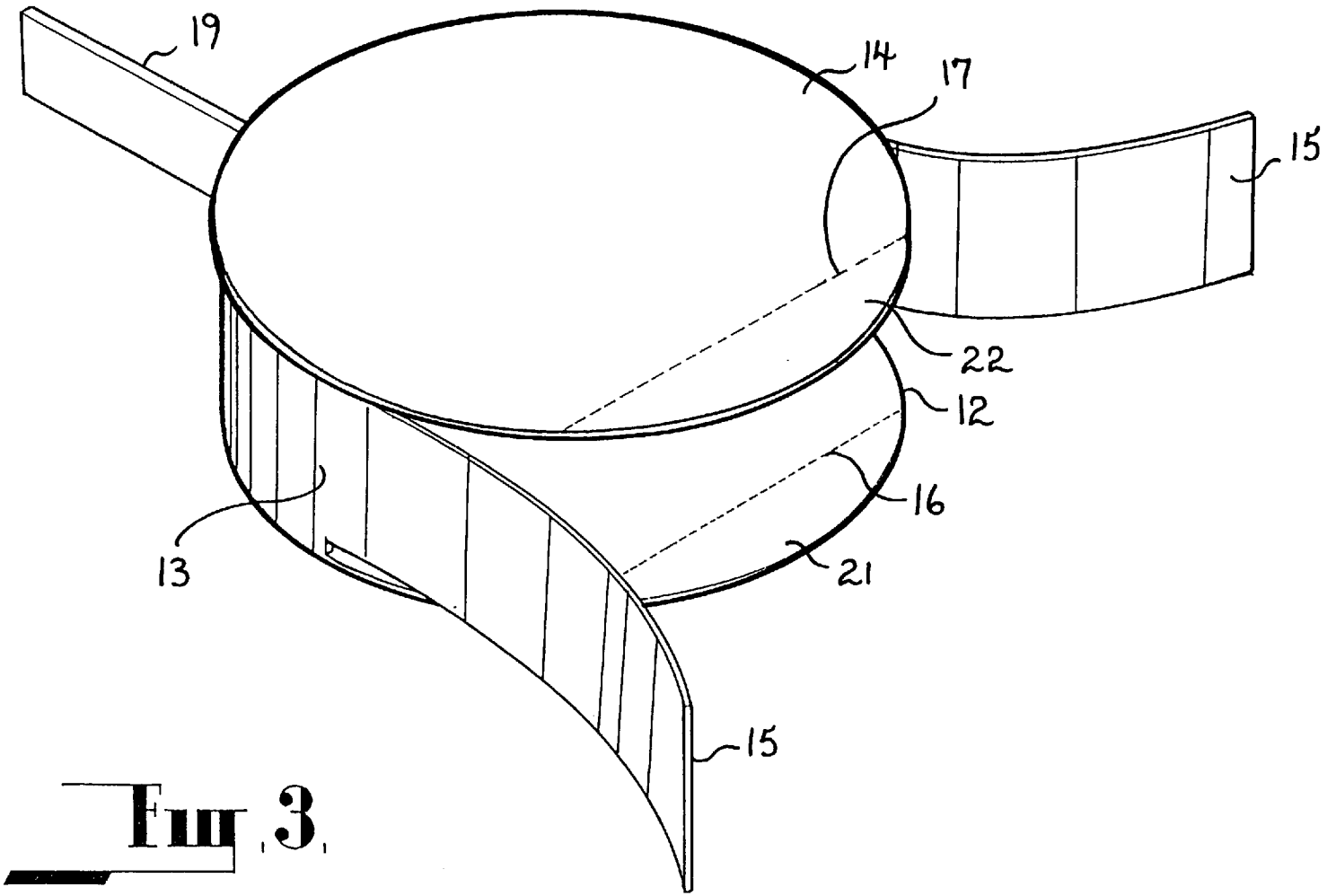
FIG. 3 is an isometric view of a second embodiment of the invention.

The second embodiment as shown at FIG. 3 is a variation from the first embodiment (the same reference numerals have been used) in which the lower and upper panels 12 and 14 are substantially circular in plan and are each provided with a chordal fold line 16 and 17 respectively. In addition, the side wall 13 fully surrounds the space between the lower panel 12 and the upper panel 14 and the end portions 15 are adapted to be interconnected. As in the case of the first embodiment, the end portions 15 are separated from the lower panel 12 or are capable of being readily separated from the lower panel 12 in order that they can be folded outwardly to be clear of the space between the lower and upper panel 12 and 14. The second embodiment provides a fully enclosed form of packaging whereby prior to consumption, the outer portions 21 and 22 of the lower and upper panels 12 and 14 can be folded about their fold lines 16 and 17 respectively to provide access to the portion of the burger therebetween. The second embodiment provides an item of packaging which can fully accommodate the burger during its production, storage and delivery to a customer with minimal handling and with the likelihood of contamination being minimised.

According to an alternative form of the first and second embodiments, the upper panel is joined to the side wall or to the lower panel and is hingeable about the joint therebetween.

Figure 4:
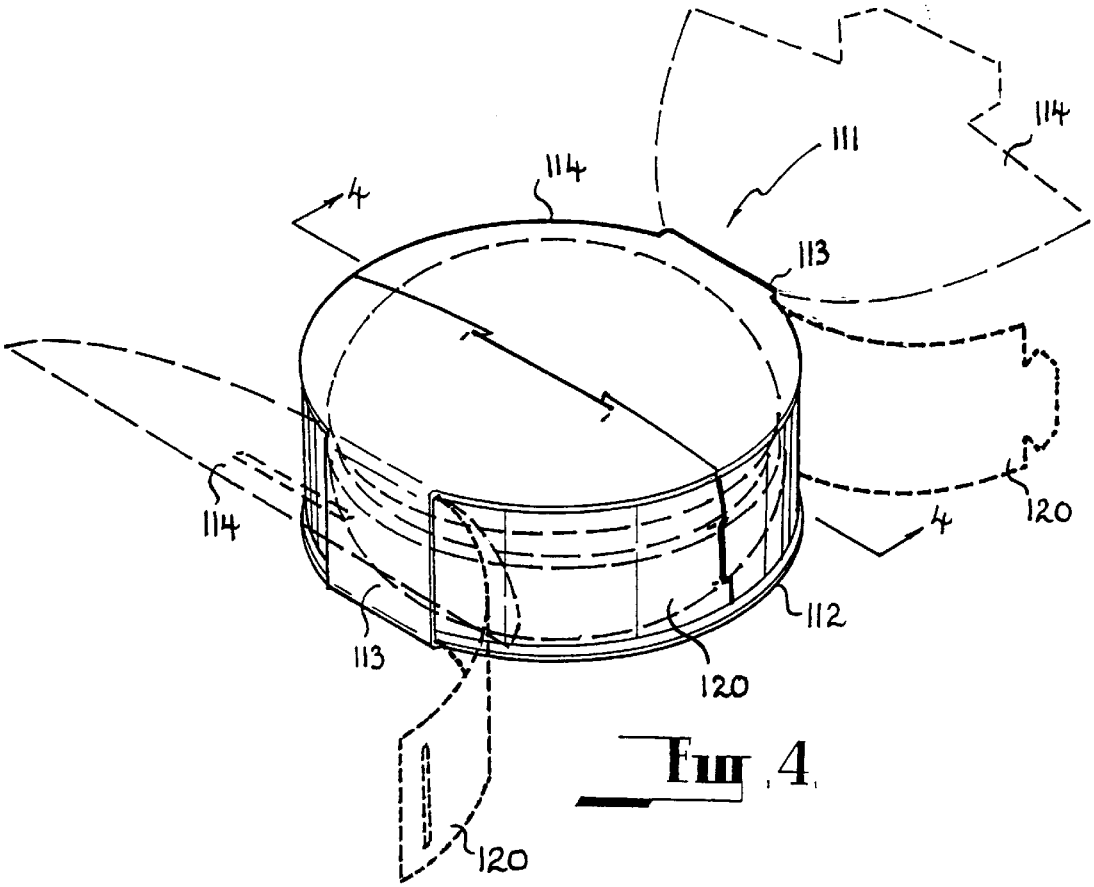
FIG. 4 is an isometric view of a third embodiment of the invention.
Figure 5:
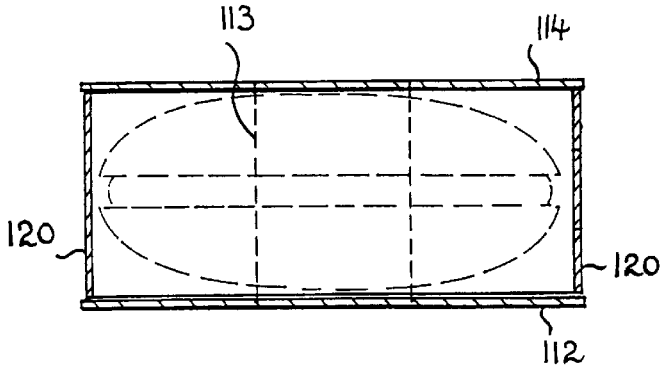
FIG. 5 is a sectional view along line 5—5 of FIG. 3.

The third embodiment as shown at FIGS. 4 and 5 comprises a holder 111 having a lower panel 112 and an upper panel 114 which are held in spaced relation by a pair of diametrically opposed side elements 113 which only extend for a short portion of the perimeter of the side walls. The upper wall 114 comprises two substantially semi-circular portions 14*a* and 14*b* which are integrally fixed to the upper ends of the perspective side elements 113 by a fold line and which are adapted at their adjacent edges to be interengaged when lying substantially parallel to the first panel 112. In the case of the third embodiment, the side wall of the packaging is defined by a strip 120 which has a width substantially corresponding to the space between the lower panel 112 and the upper panel 114 and a length substantially corresponding to the circumference of the upper and lower panels and whereby the free ends can be lockingly interconnected. The lower panel 112, the side elements 113 and the upper panel portions 114*a* and 114*b* are formed from a single blank of suitable card or paper.

When it is desired to assemble a burger, the lower panel 112 is located on a surface, the ends of the strip 120 are interconnected and the strip is located in position over the lower panel 112. The burger is then assembled on the lower panel 112 within the bounds of the side wall as defined by the strip 120. On completion of the burger, the side elements 113 are folded upwardly and the portions of the upper panel 114*a* and 114*b* are folded to overlie the space accommodating the burger and are interengaged. Once so enclosed, the burger can then be stored or delivered to customer with minimal handling of the burger.

When it becomes necessary to consume the burger, free ends of the strip 120 are preferably located intermediate of the side elements 113. The interconnected ends are then disconnected and by applying a pulling force to one or both sides of the strip 120, the burger is caused to be delivered from the space between the panels 112 and 114. As the burger is consumed, the remainder of the contents are retained in position within the burger by the presence of the side wall. As in the case of the second embodiment, the lower panel 112 and the upper panel 114 may be provided with a chordal fold line to enable a portion of the lower panel 112 and the upper panel 114 between the side elements 113 to be folded clear of the burger to provide better access to the burger during consumption.

It should be appreciated that the scope of the present invention need not be limited to the particular scope of the various embodiments described above.

The claims defining the present invention are as follows:

1. A package for accommodating a food item comprising a lower panel and an upper panel which are supported in spaced relationship to provide a space which is intended to accommodate the food item, a wall element provided between the upper and lower panels to partially surround the space between the upper and lower panels and define an opening between the upper and lower panels, the wall element including a movable portion located opposite the opening and capable of being moved across the space from a first position adjacent the wall element towards the opening to permit access to the food item from the opening with movement of said movable portion, said upper panel being nondestructively removable from above the space to provide access to the space and being replaceable to close access to the space.

2. A package as claimed in claim 1 wherein the edge of the wall element at each side of the opening supports at least one further portion capable of overlying the opening and capable of being folded outwardly from the opening.

3. A package as claimed in claim 1 wherein the wall element comprises a main portion fixed around the lower panel and wherein said movable portion comprises a separate inner wall member located within the main portion of the wall element to lie closely adjacent the main portion, and a handle is provided on the movable portion and extends outwardly beyond the main portion to be manipulable to effect said movement of said movable portion.

4. A package as claimed in claim 1 wherein the upper panel is separate from the wall element and the lower panel.

5. A package as claimed in claim 4 wherein the upper panel and the upper edges of the wall element are interengagable to resist unintentional disengagement therebetween.

6. A package as claimed in claim 1 wherein the wall element surrounds the space defined between the upper and lower panels and is capable of being opened to provide said opening to form a pair of end portions and whereby the wall element is able to move across the space in the direction of the opening.

7. A package as claimed in claim 6 wherein the upper panel is supported from the lower panel by a fold line to be movable between a closed position across the space and an opened position clear of the space.

8. A package as claimed in claim 1 wherein the edges of the upper and lower panel at the opening support a further portion capable of being folded between a position overlying the opening and another position away from said opening.

9. A package as claimed in claim 1 wherein said opening is closed by said wall element which is provided with a pair of interengaging end portions at least one of which can be disengaged from the other end portion and folded outwardly from the opening to open the side wall.

10. A package as claimed in claim 1 wherein the upper panel is connected to the wall element through a fold line.

11. A package as claimed in claim 7 wherein the upper panel comprises a pair of portions each connected to opposite sides of the lower panel and capable of being moved between the closed position and open position wherein when at the closed position, the adjacent edges of each portion can be interengaged.

* * * * *